US005360336A

United States Patent [19]

Monoe

[11] Patent Number: 5,360,336

[45] Date of Patent: Nov. 1, 1994

[54] FORCED COOLING APPARATUS FOR HEAT TREATMENT APPARATUS

[75] Inventor: Osamu Monoe, Sagamihara, Japan

[73] Assignee: Tokyo Electron Sagami Kabushiki Kaisha, Kanagawa, Japan

[21] Appl. No.: 130,844

[22] Filed: Oct. 4, 1993

Related U.S. Application Data

[63] Continuation of Ser. No. 898,596, Jun. 10, 1992, Pat. No. 5,249,960.

[30] Foreign Application Priority Data

Jun. 14, 1991 [JP] Japan ..... 3-169443

[51] Int. Cl.[5] ..... F27D 5/00; F27D 15/02

[52] U.S. Cl. ..... 432/5; 432/77; 432/83; 432/152; 432/241; 432/6

[58] Field of Search ..... 432/5, 6, 11, 241, 77, 432/83, 152

[56] References Cited

U.S. PATENT DOCUMENTS

| | | | |
|---|---|---|---|
| 5,207,573 | 5/1993 | Miyagi et al. | 432/241 |
| 5,221,201 | 6/1993 | Yamaga et al. | 432/241 |
| 5,271,732 | 12/1993 | Yokokawa | 432/5 |
| 5,273,423 | 12/1993 | Shiraiwa | 432/241 |

FOREIGN PATENT DOCUMENTS 60-8622 3/1985 Japan .

*Primary Examiner*—Henry C. Yuen
*Attorney, Agent, or Firm*—Beveridge, DeGrandi, Weilacher & Young

[57] ABSTRACT

A forced cooling apparatus for a heat treatment apparatus comprising a heat treatment furnace having a process tube with one end open at an furnace opening and another end closed at an furnace top portion; and a heater portion which covers the process tube, and wherein cooling of the heat treatment furnace is performed by forced cooling by flowing air into a gap formed between the heater portion and the process tube and which extends to the furnace top portion. The forced cooling apparatus comprises a plural number of air intake openings provided at the furnace opening portion for flowing air from an open end of the process tube and into the gap, an exhaust opening provided at the furnace top portion for flowing air which has flowed into the gap, from the vicinity of a middle portion on a side of a closed end of the process tube to outside the heater portion, an exhaust means connected to the exhaust opening, a shutter means for closing the air intake openings, and a shutter means for closing the exhaust opening. This configuration allows the air inside the furnace to be naturally exhausted from the exhaust opening to outside of the furnace, and allows uniform forced cooling of the heat treatment apparatus.

5 Claims, 3 Drawing Sheets

FORCED COOLING APPARATUS FOR HEAT TREATMENT APPARATUS

BACKGROUND OF THE INVENTION

This application is a continuation of application Ser. No. 07/898,596, filed Jun. 10, 1992, which issued as U.S. Pat. No. 5,249,960 on Oct. 5, 1993.

The present invention relates to a forced cooling apparatus for a heat treatment apparatus, for cooling a heater of a heat treatment apparatus used for example, in processes for the manufacture of semiconductor devices and the like.

The following is a description of a conventional example of a forced cooling apparatus for a heat treatment apparatus, used in processes for the manufacture of semiconductor devices and the like.

In such a heat treatment apparatus, heating semiconductor wafers by a required processing gas performs for example, the formation of an oxide film on the semiconductor wafer, thin film deposition by a thermal CVD method or the formation of high impurity concentration regions by a thermal diffusion method.

In addition, in such heat treatment apparatus, the temperature of the inside of the process tube is normally cooled to a required temperature after the heat treatment has been performed and then the semiconductor wafers are conveyed to outside of the furnace. When these high-temperature semiconductor wafers are carried to outside of the furnace, there is the formation of a natural oxidation film on the surface of the semiconductor wafers. This causes a reduction of the yield when semiconductor devices are manufactured from these semiconductor wafers, and also causes deterioration of the characteristics of the manufactured semiconductor wafers.

Also, with the recently increased requirements for higher integration and high speeds of integrated circuits, it is required that there be control for the depth of diffusion to semiconductor wafers. Controlling the depth of diffusion so that it is shallow requires that the semiconductor wafer which is the object of processing be raised to a required temperature in a short time and that the same program for the required temperature hold time and the temperature lowering time be reproduced for each processing.

Techniques for the uniform and fast performing of cooling inside a process tube of a heat treatment apparatus have been disclosed in Japanese Patent Laid-Open Publication (KOKAI) No. 121429-1988 and Japanese Patent Laid-Open Publication No. 8128-1988.

The apparatus disclosed in Japanese Patent Laid-Open Publication No. 121429-1988 performs cooling of the process tube by an spiral air flow formed along the outer periphery of a processing tube of a heat treatment apparatus.

In addition, the apparatus disclosed in Japanese Patent Laid-Open Publication No. 8128-1988 has the one opening of the furnace provided with either one or a plural number of air ejection pipes for the supply of cooled and compressed air between the process tube and the heater coil of the heat treating furnace, and is also provided with a plural number of air exhaust pipes for the exhaust of air from the furnace opening at the other end.

However, even with these conventional art, it was still not possible to have a sufficient uniformity of cooling and cooling speed for the process tube.

In addition, with the apparatus disclosed in Japanese Patent Laid-Open Publication No. 121429-1988, in actuality, it is extremely difficult to form a spiral-shaped air flow along the surface of the outer periphery of the process tube. In addition, even assuming that it was possible to form a spiral-shaped air flow along the surface of the outer periphery of the process tube through the provision of a means for guiding the flow of introduced air into a spiral shape, one still could not expect a sufficient cooling speed since there would be a large resistance to the flow of air.

On the other hand, with the apparatus disclosed in Japanese Patent Laid-Open Publication No. 8128-1988, pipes are used for the supply of the cooling air to the process tube, and also for its exhaust and so it is easy for the air flow to become uneven. There is also a limit to the degree of improvement of uniformity of cooling. Also, with this apparatus, the supply of the air for cooling is performed forcedly and its exhaust is also performed forcedly and so it is difficult to generate a uniform air flow around the periphery of the process tube.

Furthermore, this same problem exists with apparatus disclosed in Japanese Patent Laid-Open Publication No. 94626-1990 and Japanese Patent Laid-Open Publication No. 224217-1991.

SUMMARY OF THE INVENTION

This invention relates to the forced cooling apparatus for a heat treatment apparatus having a forced cooling apparatus that allows air to flow into a gap formed between a heater portion and a process tube to perform the cooling of a furnace having a process tube of the vertical type therein and which has a lower end open in a furnace opening portion, and a heater portion which covers a process tube, the forced coding apparatus comprising:

a plural number of air intake openings for intaking air from a side of an open end of a process tube and into a gap provided at a furnace opening portion, an exhaust opening for allowing air inside a gap provided to a furnace top portion to flow to outside the heater from a central portion of a closed end of a process tube, a shutter means for closing the exhaust opening, and an air exhaust means connected to the exhaust opening.

With such a forced cooling apparatus for a heat treatment apparatus, it is desirable that there be further provided a shutter means for closing an air intake opening.

By the adoption of such a configuration, it is possible to reduce the resistance to the flow of the air which flows in the gap between the heater and the process tube and so it is possible to increase the amount of flow of the air. Because of this, it is possible to increase the speed of cooling of the process tube.

In addition, according to the forced cooling apparatus of the present invention, it is possible to reduce the eddies of the air which flows in the gap between the heater portion and the process tube and so it is possible to have more uniform cooling of the heat treatment furnace.

Furthermore, the provision of the shutter means for closing the exhaust opening of the heat treatment furnace prevents the flowing out and the flowing in of the air between the outside and the gap during heat treatment enables the uniformity of the heating and the heating efficiency to be further improved.

DETAILED DESCRIPTION OF THE PREFERRED EMBODIMENTS

The following is a description of a first embodiment of the heat treatment furnace forced cooling apparatus according to a-first embodiment of the present invention, with reference to the appended drawings and using the example of when it is mounted to a vertical type of heat treatment apparatus.

Figure 1:
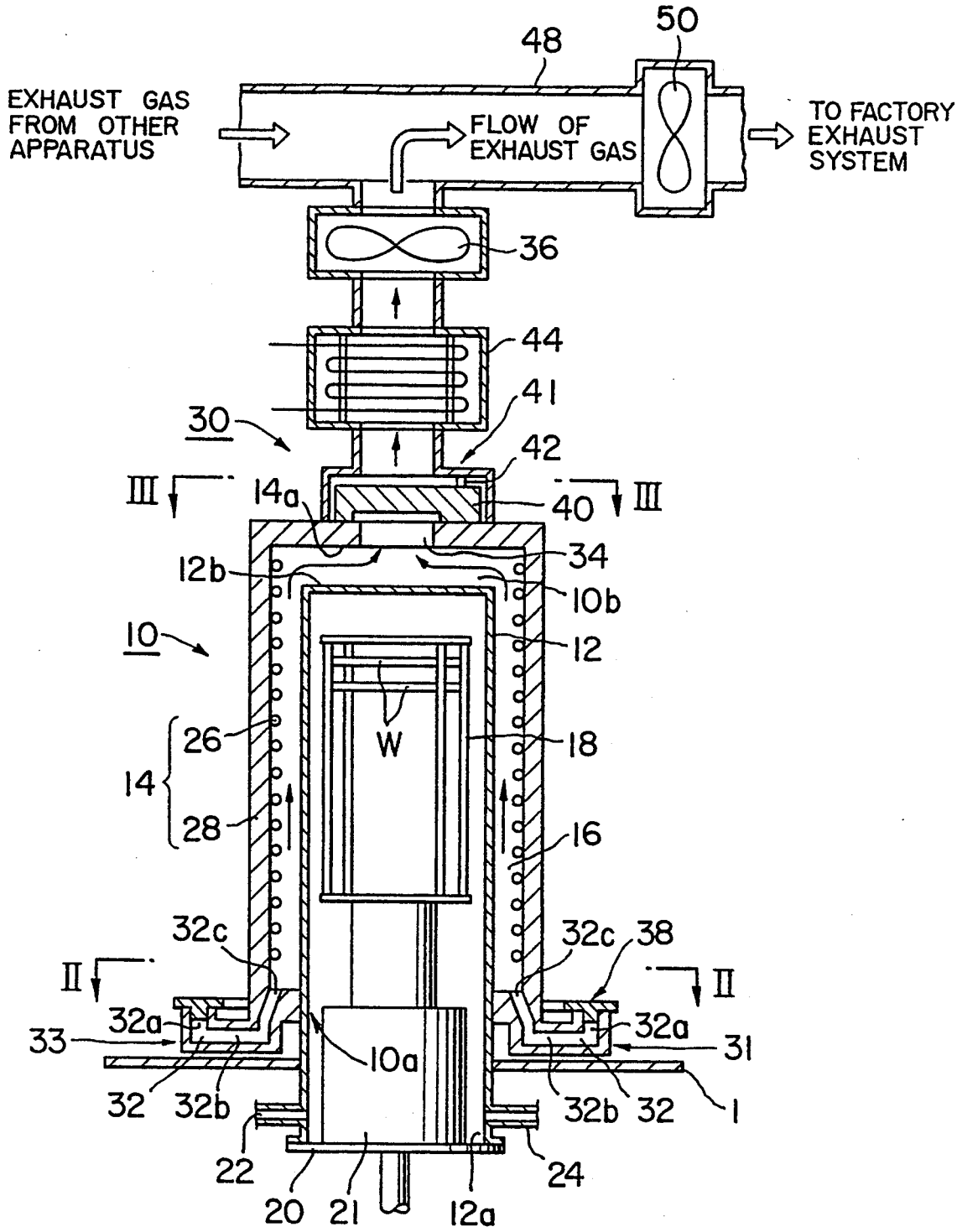
FIG. 1 is a vertical sectional schematic view of a configuration of a vertical type of heat treatment apparatus having the heat treatment furnace forced cooling apparatus according to a first embodiment of the present invention.

As shown in FIG. 1, the heat treatment furnace 10 of the first embodiment of the present invention has a heater portion 14 and a process tube 12 mounted to a base 1. In addition, a required gap 16 is formed between the process tube 12 and the heater portion 14 which surrounds it.

This process tube 12 is configured from glass, for example. A wafer boat 18 having a temperature retention cylinder 21 at its lower portion is inserted through an opening at the lower side of the process tube 12. Moreover, this wafer boat 18 is configured so that it can hold many (such as 25 to 150, for example) semiconductor wafers W in the direction of the wafer thickness.

In addition, an opening 12*a* on the lower side of the process tube 12 is airtightly sealed by a lid 20 provided to the lower side of the temperature retention cylinder 21. By this, a vacuum is created inside the process tube 12 using an air exhaust pipe 24 provided to the lower side and furthermore, it is possible to introduce a required processing gas into the process tube 12 from a gas introduction pipe 22 while performing exhaust from the air exhaust pipe 24.

The heater portion 14 which covers the process tube 12 is configured from a heater device (such as a heater coil) 26, and an insulating body 28 which is in tight contact with and covers the heater device 26. The heater device 26 can use a resistance heat generating body (a coil), of molybdenum disilicide ($MoSi_2$). Such a resistance heating element can quickly raise the temperature by 50°-100° C. per minute and it is possible to have a large improvement in the speed of heating inside the process tube 12.

Also, to the upper portion of the heat treatment furnace 10 is provided a forced cooling apparatus 30. This forced cooling apparatus 30 is provided with a plural number of air intake openings formed in an air intake duct 33, an exhaust opening 34 provided to an upper portion of the heat treatment furnace 10, a heat exchanger 44 connected to the exhaust opening 34, and an exhaust fan 36 provided as an air exhaust means connected to the heat exchanger 44.

Air intake openings 32 are provided so as to make the air outside of the apparatus flow to into the process tube 12 from the bottom end portion (opening end portion) of the gap 16 formed between the process tube 12 and the heater portion 14. These air intake openings 32 communicate with the outside air and are configured from an air intake opening 32*a*, a communicating port 32*b* and an air introduction opening 32*c*. In this manner, the air intake openings 32 are desirably positioned at equidistant intervals in the peripheral direction of the opening end portion (furnace opening) of the heater portion 14.

In this first embodiment, a plural number of such air intake openings 32 are provided inside the air intake duct 33 and so function as an exhaust opening 34 to be described later, and allow the air to flow uniformly across the entire area of the gap 16. Accordingly, it is possible to improve the uniformity of cooling in the vertical direction of the heat treatment furnace 10. Furthermore, a plural number of air intake openings 32 are provided and so it is possible to minimize the resistance to the flow of air and therefore improve the speed of cooling.

In this first embodiment, the number of the air intake openings 32 is 16. From this, it can be possible to obtain a sufficient speed and uniformity of cooling for the heat treatment furnace 10.

Moreover, only these air intake openings 32*a* are provided in plural while the communicating ports 32*b* and the air introduction opening 32*c* can be configured so as to be mutually communicated inside the air intake duct 33.

In addition, the exhaust opening 34 is provided so as to make the air inside the gap 16 flow naturally into and outside of the apparatus. This exhaust opening 34 is provided to a central portion (furnace top portion 10*b*) of the upper surface 14*a* of the heater portion 14. By this, the temperature difference between the vicinity of the inside upper surface 14*a* of the heater portion 14 and the vicinity of the top surface 12*b* of the process tube 12 can be lessened and sufficiently more uniform cooling guaranteed. More specifically, the air that is introduced from the plural number of air intake openings 32 flows from top to bottom in the gap 16 along the outer peripheral surface of the process tube 12 and is collected in one place by the exhaust opening 34 and is naturally exhausted to outside of the apparatus. Because of this, it is difficult for there to be unevenness in the air flow when there is flow around the outer peripheral surface of the process tube 12 and it is possible to have uniform cooling of the process tube 12 and the heat treatment furnace 10.

Moreover, the air that is discharged from the exhaust opening 34 is cooled by the heat exchanger 44 so as to prevent a temperature rise inside the factory, and is then exhausted from an exhaust duct 48 to the factory exhaust system by an exhaust fan 50.

This exhaust fan 36 which is connected downstream of the exhaust opening 34 is used to exhaust the air inside the gap 16 of the heat treatment furnace 10 to outside of the apparatus. In addition, if this air inside the gap 16 is exhausted in this manner, the action of the negative pressure due to the exhaust fan 36 enables the air outside of the apparatus to flow naturally into the gap 16 through the air intake openings 32. More specifically, with the forced cooling apparatus of the first embodiment of the present invention, the exhaust fan 36 is used and air from outside of the apparatus is made to flow into the gap 16 by the air intake openings 32, and furthermore, this air inside the gap 16 flows out from the exhaust opening 34 to outside of the apparatus to generate a natural flow of air inside the gap 16 to perform cooling of the heat treatment furnace 10.

Moreover, forced exhaust is performed by the exhaust fan 36 for only the exhaust opening 34 and a means (hereinafter referred to as an "air intake means") for performing forced air intake is not provided to the air intake openings 32 for the following reason.

Namely, that if an exhaust fan 36 is connected to the exhaust opening 34 and an means for forced air intake is also provided to the air intake openings 32, then for example, should the exhaust fan 36 fail so that the amount of air intake was greater than the amount of air exhaust, air would be forcedly introduced into the gap 16 due to this air intake means and this would cause the air pressure inside the gap 16 to rise. Then, the air inside the gap 16 would be discharged from the gap of the apparatus to outside of the apparatus but this air leakage would become a cause of generation of dust and the like and so the yield of the semiconductor devices would be decreased.

With respect to this, when only the air from the exhaust opening 34 is forcedly exhausted using the exhaust fan 36, then should the exhaust fan 36 fail, the air that is flowing inside the gap 16 will merely cease to flow and as a result, there will be no generation of dust although sufficient cooling of the heat treatment furnace 10 will no longer be performed.

Furthermore, with the first embodiment, air exhaust is not performed by the action of positive pressure through the supply of compressed air and as described above, the forced exhaust of air by the exhaust fan 36 and the action of the negative pressure due to this performs the intake of air from the air intake openings 32. By this, it is possible to further reduce the unevenness of air flow inside the gap 16.

In addition, the forced cooling apparatus of the first embodiment of the present invention is provided with a shutter means 40 to block the exhaust opening 34 and a shutter means 38 to block the air intake openings 32. Moreover, the shutter means 38 for the air intake openings 32 is configured from teflon (registered trademark) and stainless steel for example, and the shutter means 40 for the exhaust opening 34 is configured for example, from glass or the like. In the first embodiment, when cooling of the heat treatment furnace 10 is performed, and especially when there is heating inside the process tube 12 by the heater device 26, these shutter means 38 and 40 are used to block the air intake openings 32 and the exhaust opening 34.

Figure 2:
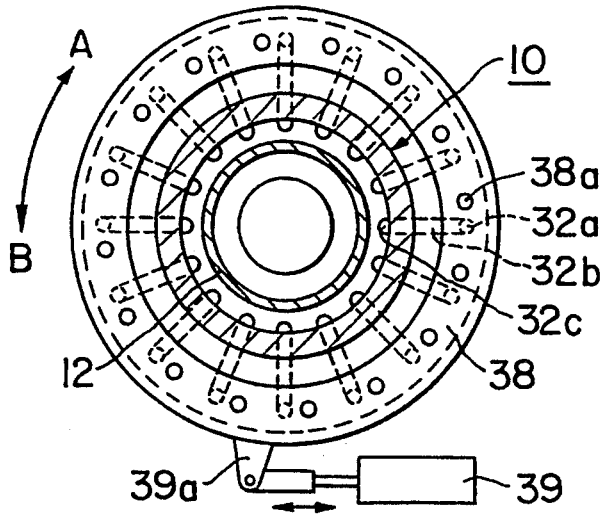
FIG. 2 is a perspective sectional view along section line II—II of FIG. 1, showing a configuration of a shutter means provided to an air intake opening of the heat treatment furnace forced cooling apparatus according to the first embodiment of the present invention.

As shown in FIG. 2, this air intake opening shutter means 38 is configured by air intake openings 38*a* being provided at the same intervals as the air intake openings 32*a*, as a ring-shaped plate. If such a configuration is used, then simply rotating the shutter means 38 by a rotating link mechanism 39*a* and an air cylinder 39 through only a required angle in one direction (shown in FIG. 2 by the arrow A) enables the shutter means 38 to move along the circular groove formed in the air intake duct 33 and simultaneously open each of the air intake openings 32*a*. In addition, by using the air cylinder 39 to rotate the shutter means 38 in the opposite direction (shown here by the arrow B), it is possible to close all of the air intake openings 32*a* at the same time.

Figure 3:
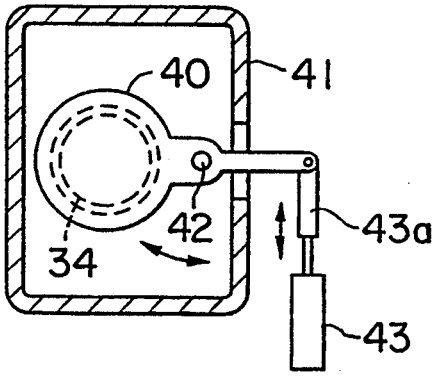
FIG. 3 is a perspective sectional view along section line III—III of FIG. 1, showing a configuration of a shutter means provided to an air exhaust opening of the heat treatment furnace forced cooling apparatus according to the first embodiment of the present invention.

In addition, as shown in FIG. 3, the shutter means 40 of the air exhaust opening 34 is supported by a pivot 42 which is housed in a casing 41. The configuration is such that rotating a cylinder rod 43*a* and an air cylinder 43 about this pivot 42 and in the direction shown by the arrow opens and closes the air exhaust opening 34.

Figure 4:
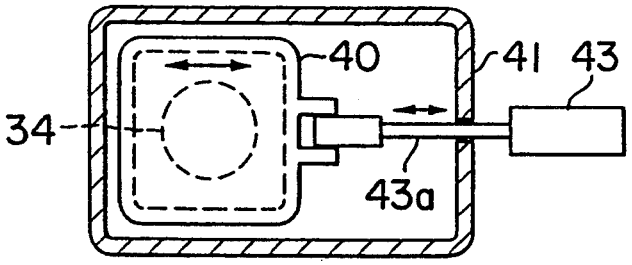
FIG. 4 is a horizontal sectional view showing another embodiment of the shutter means shown in FIG. 3.

Moreover, as shown in FIG. 4, this shutter means 40 can have a structure whereby the cylinder rod 43*a* and the air cylinder 43 open and close by moving back and forth.

Through the use of the shutter means 38 to close the air intake openings, it is possible to prevent low-temperature external air from flowing into the gap 16, and to prevent the high temperature air inside the gap 16 from flowing out from the air intake openings 32 when the inside of the process tube 12 is heated. By this, it is possible to prevent disturbance of the uniformity of temperature and to prevent a lowering of the heating efficiency.

Also, as shown in FIG. 1, the air which flows out from the air exhaust opening 34 is normally cooled by the heat exchanger 44 and is then sent to the exhaust duct of the plant exhaust system, and is discharged to outside of the plant along with the exhaust from other apparatus. According to investigations performed by the inventors, it was understood that when an air exhaust opening is connected to such an air exhaust system, then a small amount of air still flows from the air exhaust opening 34 even should the exhaust fan 36 stop.

This flow of air becomes a cause of disturbances to the uniformity of temperature and of lowering of the heating efficiency in the same way as it is for the air intake openings 32 and so the air exhaust opening 34 is also provided with a shutter means 40 to prevent such a flow of air and to prevent heat dispersion during heating.

The following is a description of the operation of a vertical type of heat treatment apparatus to which the forced cooling apparatus of the present invention and as shown in FIG. 1 has been applied.

(1) First, the shutter means 38 and 40 are closed and the air intake openings 32 and the air exhaust opening 34 are closed.

(2) Then, the wafer boat 18 which houses the semiconductor wafers W is raised by the carrying means (not shown), and is placed inside the process tube.

(3) After this, the gas introduction tube 24 is used to exhaust the gas inside the process tube 12 while the gas introduction tube 22 is used to introduce the treating gas to inside the process tube 12.

(4) Then, the switch of the heating device 26 is turned on and the inside of the process tube is heated to a temperature of from 600° C. to 1000° C. for example and the required treatment is performed to the semiconductor wafers W. When this is done, the air intake openings 32 and the air exhaust opening 34 are closed by the shutter means 38, 40 so that as described above, the thermal efficiency of the heat treatment furnace 10 is improved and the is no disturbance to the uniformity of temperature. In addition, the use of resistance heat generating body of molybdenum disilicide ($MoSi_2$) allows heating to be performed quickly.

(5) When the treating is finished, the switch of the heating device 26 is turned off and a purge gas such as $N_2$ or the like is introduced into the process tube 12. While this is being done, the $N_2$ gas is allowed to flow (at 20–30 liters/minute, for example). Then, the shutter means 38, 40 are opened, the air intake openings 32 and the exhaust opening 34 are opened, and the exhaust fan 36 is driven so that air external to the apparatus is made to flow into the gap 16 from the air intake openings, and this air inside the gap 16 flowing from the exhaust opening 34 to outside of the apparatus enables the air inside the gap 16 to flow naturally, and enable the quick and uniform cooling of the heat treatment furnace 10.

(6) Furthermore, after the temperature inside the process tube 12 has dropped to a predetermined temperature, the wafer boat 18 is lowered, and the treated semiconductor wafers W are taken from the inside of the process tube 12.

As has been described above, according to the forced cooling apparatus for the heat treatment furnace relating to the first embodiment of the present invention, it is possible to reduce the air resistance to the air which flows in the gap 16 between the process tube 12 and the heater portion 14 so that it is possible to further increase an amount of air which flows inside the gap 16. Accordingly, it is possible to have a fast cooling speed for the heat treatment furnace 10. According to investigations performed by the inventors, it is possible to have high-speed cooling of 50° C./minute for a temperature drop range of from 100° C. to 600° C. for example, when measured on semiconductor wafers and for there to be a temperature difference of less than 20° C. for between all processed wafers.

In addition, it is possible to reduce the disturbance to the flow of air inside the gap 16 between the process tube 12 and the heater portion 14 and so it is possible to have uniform cooling for all of the process tube.

Furthermore, the provision of the shutter means 38 and 40 to the air intake openings and the exhaust opening 34 enables the prevention of disturbances to the uniformity of temperature and also prevents the lowering of the heating efficiency when the inside of the process tube is heated by the heater mechanism.

Moreover, with the first embodiment described above, the description was given for the example of a vertical type of heat treatment apparatus using the heat treatment apparatus forced cooling apparatus of the present invention but it is of course possible to have the same effect for a horizontal type of heat treatment apparatus.

Figure 5:
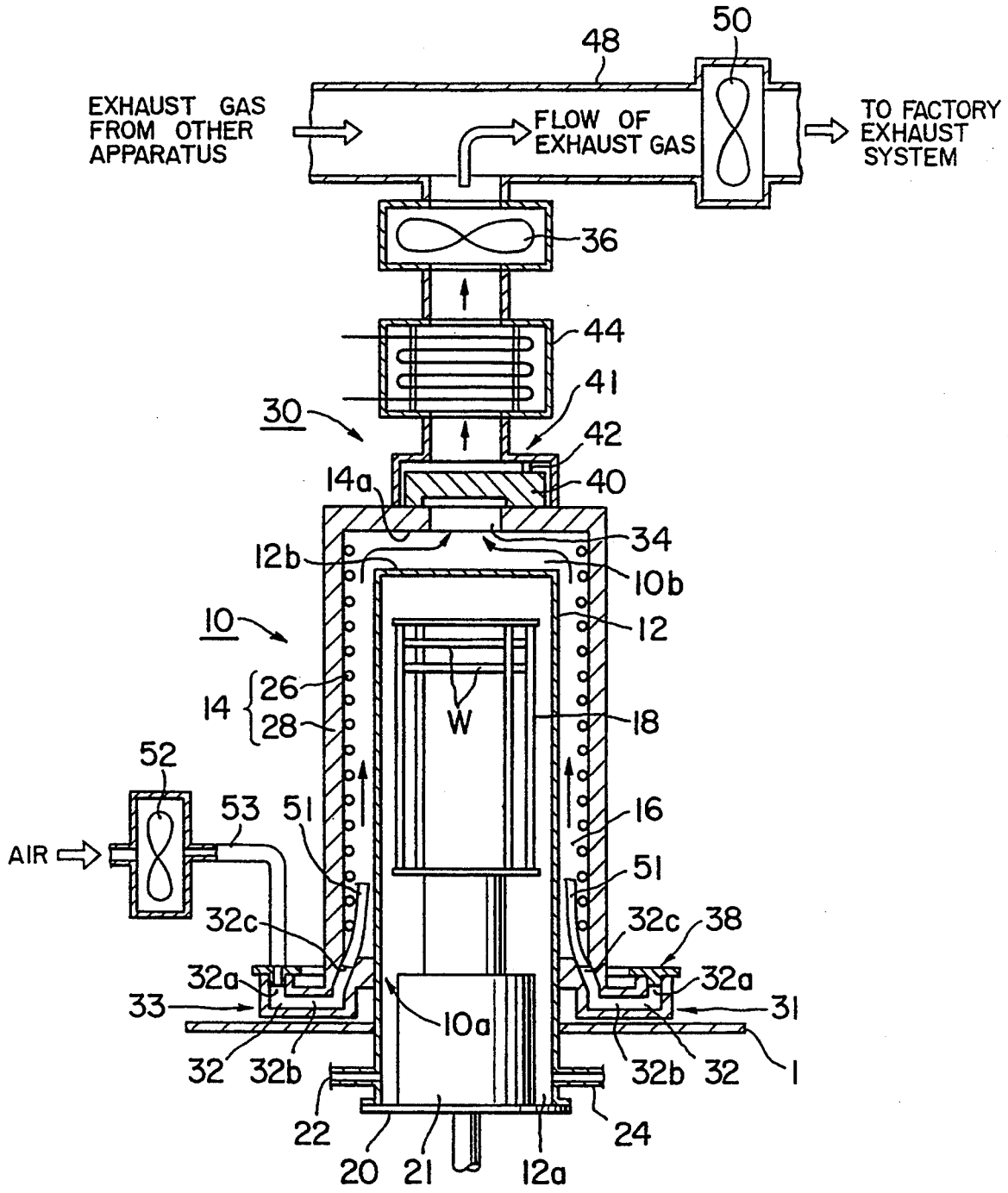
FIG. 5 is a vertical sectional view showing an outline of a configuration of a of a shutter means provided to an air intake opening of the heat treatment furnace forced cooling apparatus according to a second embodiment of the present invention.

The following is a description of a heat treatment apparatus forced cooling apparatus according to a second embodiment of the present invention when applied to a vertical type of heat treatment apparatus and with reference to FIG. 5.

With the heat treatment apparatus forced cooling apparatus according to the first embodiment of the present invention and shown in FIG. 1, the cooling speed in the vertical direction of the process tube becomes non-uniform because the air intake is natural but assisted by the exhaust fan, and there is the tendency for there to be overcooling of the process tube in the vicinity of the furnace entrance.

With this heat treatment apparatus forced cooling apparatus according to the second embodiment of the present invention, the basic configuration is the same as that of the heat treatment apparatus forced cooling apparatus according to the first embodiment of the present invention but as shown in FIG. 5, there are nozzles 51 inserted into the air introduction opening **32*c* of the first embodiment, the shutter 38 is fixed to the duct 33, and a blower 52 is connected to the air intake opening 32 and air is forcedly pushed into the furnace so that the forced cooling of the heat treatment furnace 10** is promoted.

More specifically, as shown in FIG. 5, with this second embodiment, 8 pieces of nozzles 51 are inserted at equidistant intervals into the air introduction opening **32*c* formed in the duct 33, so that is evenly injected into the gap 16 and rises evenly along the process tube 12. The nozzles 51 are made of glass, are oval in section and have dimensions of 25 mm long by 12 mm wide, and a length of about 200 mm. However, the structure of the nozzles 51** can be changed to provide more uniformity of flow in the vertical direction and for example, can be circular in section.

Furthermore, the shutter means 38 which has a circular shape and which is fixed to the upper surface of the duct 33 is provided at one opening and is connected to the blower 52 via an air feed tube 53. This structure allows air to be forcedly pushed into the air intake opening 32 due to the rotation of the blower 52, and be injected from the nozzles 51 into the gap 16 formed between the heater device 26 and the process tube 12. Uniform forced cooling is therefore carried out along the process tube 12.

The following is a description of the operation of the second embodiment of a forced cooling apparatus of the present invention. When there is forced cooling, the switch of the heater device 26 is first turned off, and then the shutter means 40 of the exhaust opening 34 is opened. The exhaust fan 36 is then driven and the blower 52 is then driven a few seconds later, and air is pushed into the air intake openings 32 and air is ejected at a predetermined time from the nozzles 51 and forced cooling of the process tube 12 is performed. After this, the wafer boat 18 is lowered, and the semiconductor wafers W which have been treated are taken from the process tube.

When compared to an air cooling apparatus of the first embodiment of the invention, the forced cooling apparatus of the second embodiment of the present invention, it is possible to have an approximately 30% improvement in the uniformity of cooling between all treated wafers in the vertical direction.

What is claimed is:

1. A heat treatment process using a heat treatment furnace having a process tube having a lower end open at a bottom portion of a furnace and a closed upper end at a top portion of said furnace, and a furnace heating portion provided about a side wall of said process tube, and wherein cooling of said heat treatment apparatus is performed by flowing cooling gas through a gap formed between said process tube and said furnace portions, said heat treatment process comprising:

closing a gas intake opening which introduces said cooling gas into said gap;

closing an exhaust opening which exhausts said gas from said gap;

introducing an object for processing into said process tube;

heating said process tube to a predescribed heat treatment temperature;

heat treating said object for a predescribed time period;

opening said gas intake opening and said gas exhaust opening;

flowing cooling gas upwardly through said gap so as to cool said process tube to a predescribed temperature; and removing said object from said process tube.

2. The heat treatment process of claim 1, wherein said gas is air.

3. The heat treated process of claim 1, further comprising cooling said gas exhausted through said exhaust means by passing through a heat exchanger.

4. The heat treated process of claim 1, wherein said cooling gas is forcibly introduced into said gap.

5. The heat treatment process of claim 4, wherein said cooling gas is forcibly introduced by utilizing a blower.

* * * * *